US009931832B2

(12) United States Patent
Schaede

(10) Patent No.: US 9,931,832 B2
(45) Date of Patent: Apr. 3, 2018

(54) MULTICOLOUR LETTERPRESS PRINTING PRESS HAVING NUMBERING CYLINDERS AND AN ADDITIONAL PRINTING

(71) Applicant: KBA-NOTASYS SA, Lausanne (CH)

(72) Inventor: Johannes Georg Schaede, Würzburg (DE)

(73) Assignee: KBA-NotaSys SA, Lausanne (CH)

( * ) Notice: Subject to any disclaimer, the term of this patent is extended or adjusted under 35 U.S.C. 154(b) by 0 days.

(21) Appl. No.: 15/116,505

(22) PCT Filed: Feb. 3, 2015

(86) PCT No.: PCT/IB2015/050817

§ 371 (c)(1),
(2) Date: Aug. 3, 2016

(87) PCT Pub. No.: WO2015/118447

PCT Pub. Date: Aug. 13, 2015

(65) Prior Publication Data

US 2017/0008271 A1 Jan. 12, 2017

(30) Foreign Application Priority Data

Feb. 4, 2014 (EP) ..... 14153895
Jul. 22, 2014 (EP) ..... 14177949

(51) Int. Cl.
*B41F 11/00* (2006.01)
*B41F 11/02* (2006.01)
(Continued)

(52) U.S. Cl.
CPC ..... *B41F 31/20* (2013.01); *B41F 5/18* (2013.01); *B41F 11/02* (2013.01); *B41F 31/00* (2013.01); *B41F 31/18* (2013.01); *B41K 3/126* (2013.01)

(58) Field of Classification Search
CPC .. B41F 5/18; B41F 11/02; B41F 31/00; B41F 31/18; B41F 31/20; B41K 3/126
See application file for complete search history.

(56) References Cited

U.S. PATENT DOCUMENTS 3,404,626 A * 10/1968 White ..... B41F 13/28 101/177
4,509,424 A 4/1985 Germann
(Continued)

FOREIGN PATENT DOCUMENTS

DE 2115790 A1 10/1972
EP 0 061 795 A1 10/1982
(Continued)

OTHER PUBLICATIONS

Handbook of Print Media: Technologies and Production Methods, Helmut Kipphan (Editor), ISBN 3-540-67326-1, Springer-Verlag Berlin Heidelberg, 2001, Chapter 2.3 "Letterpress Printing", pp. 395-408, and Chapter 2.5.1 "Security Printing", pp. 423-433.

*Primary Examiner* — Matthew G Marini
*Assistant Examiner* — Marissa Ferguson Samreth
(74) *Attorney, Agent, or Firm* — Nixon & Vanderhye P.C.

(57) ABSTRACT

There is described a multicolor letterpress printing press, in particular a numbering press, comprising a printing group (50) with at least a first letterpress (e.g. numbering) cylinder (51) and a second letterpress cylinder (52) which are inked by an associated inking system (60, 71, 72, 81, 81 *a*, 81 *b*, 82, 82*a*, 82*b*). The inking system (60, 71, 72, 81, 81 *a*, 81 *b*, 82, 82*a*, 82*b*) comprises (i) a first inking device (81) supplying ink to a first chablon cylinder (71), (ii) at least a second inking device (82) supplying ink to a second chablon cylinder (72), and (iii) an ink-collecting cylinder (60) contacting the first and second chablon cylinders (71, 72) and the first and second letterpress cylinders (51, 52). The ink-collecting cylinder (60) collects a first ink pattern (A, D)
(Continued)

from the first chablon cylinder (71) and a second ink pattern (B, C) from the second chablon cylinder (72). As a result, a first multicolor pattern of inks (A-D) is formed on the ink-collecting cylinder (60), which first multicolor pattern of inks (A-D) is transferred onto the first letterpress cylinder (51). The ink-collecting cylinder (60) further collects a third ink pattern (A, D) from the first chablon cylinder (71) and a fourth ink pattern (B, C) from the second chablon cylinder (72), thereby forming a second multicolor pattern of inks (A "D) on the ink-collecting cylinder (60), which second multicolor pattern of inks (A "D) is transferred onto the second letterpress cylinder (52).

16 Claims, 11 Drawing Sheets

(51) Int. Cl.

| | |
|---|---|
| ***B41F 31/20*** | (2006.01) |
| ***B41K 3/12*** | (2006.01) |
| ***B41F 5/18*** | (2006.01) |
| ***B41F 31/00*** | (2006.01) |
| ***B41F 31/18*** | (2006.01) |

(56) References Cited

U.S. PATENT DOCUMENTS

| | | | |
|---|---|---|---|
| 4,633,777 | A | 1/1987 | Germann |
| 4,640,189 | A | 2/1987 | Hernandez |
| 4,677,910 | A | 7/1987 | Kuhfuss |
| 4,697,515 | A | 10/1987 | Germann |
| 4,843,959 | A | 7/1989 | Rendell |
| 5,007,339 | A | 4/1991 | Germann |
| 5,009,156 | A | 4/1991 | Germann |
| 5,036,763 | A | 8/1991 | Germann |
| 5,042,378 | A | 8/1991 | Germann |
| 6,311,616 | B1 | 11/2001 | Kamoda |
| 6,595,130 | B2 | 7/2003 | Uehara |
| 7,096,784 | B2 | 8/2006 | Giori et al. |
| 7,273,008 | B2 | 9/2007 | Giori et al. |
| 8,328,194 | B2 | 12/2012 | Reinhard et al. |
| 8,499,687 | B2 | 8/2013 | Gygy et al. |
| 8,726,805 | B2 | 5/2014 | Stöhr et al. |
| 8,783,685 | B2 | 7/2014 | Reinhard et al. |
| 8,800,447 | B2 | 8/2014 | Schwitzky et al. |
| 8,813,644 | B2 | 8/2014 | Gygi et al. |
| 9,174,430 | B2 | 11/2015 | Kanayama et al. |
| 9,283,743 | B2 | 3/2016 | Schaede et al. |
| 2002/0043167 | A1 | 4/2002 | Uehara |
| 2004/0026851 | A1 | 2/2004 | Schaede et al. |
| 2005/0223922 | A1 | 10/2005 | Giori et al. |
| 2006/0208412 | A1 | 9/2006 | Reinhard et al. |
| 2006/0213384 | A1 | 9/2006 | Reinhard et al. |
| 2006/0249040 | A1 | 11/2006 | Giori et al. |
| 2008/0271620 | A1 | 11/2008 | Hoier et al. |
| 2009/0003656 | A1 | 1/2009 | Reinhard et al. |
| 2009/0095178 | A1 | 4/2009 | Schwitzky et al. |
| 2009/0101030 | A1 | 4/2009 | Stohr et al. |
| 2010/0170408 | A1 | 7/2010 | Gygi et al. |
| 2012/0160116 | A1 | 6/2012 | Endo |
| 2012/0312180 | A1* | 12/2012 | Scheade ..... B41F 9/021 101/216 |
| 2013/0139709 | A1 | 6/2013 | Kanayama et al. |
| 2013/0176356 | A1 | 7/2013 | Reinhard et al. |
| 2013/0213246 | A1 | 8/2013 | Schaede et al. |
| 2013/0284946 | A1 | 10/2013 | Schaede |
| 2013/0298791 | A1 | 11/2013 | Gygi et al. |
| 2016/0185102 | A1 | 6/2016 | Schaede et al. |

FOREIGN PATENT DOCUMENTS

| | | | |
|---|---|---|---|
| EP | 0 092 887 | A1 | 11/1983 |
| EP | 0 132 858 | A1 | 2/1985 |
| EP | 0 167 196 | A1 | 1/1986 |
| EP | 0 219 159 | A1 | 4/1987 |
| EP | 0 286 317 | A1 | 10/1988 |
| EP | 0 343 105 | A2 | 11/1989 |
| EP | 0 343 106 | A2 | 11/1989 |
| EP | 0 343 107 | A2 | 11/1989 |
| EP | 0 351 366 | A2 | 1/1990 |
| EP | 1 046 498 | A1 | 10/2000 |
| EP | 1 197 332 | A1 | 4/2002 |
| EP | 2 433 798 | A1 | 3/2012 |
| EP | 2 468 506 | A1 | 6/2012 |
| EP | 2 599 631 | A1 | 6/2013 |
| JP | 2000-85095 | A | 3/2000 |
| WO | 01/85457 | A1 | 11/2001 |
| WO | 01/85586 | A1 | 11/2001 |
| WO | 2005/008605 | A1 | 1/2005 |
| WO | 2005/008606 | A1 | 1/2005 |
| WO | 2006/051563 | A1 | 5/2006 |
| WO | 2006/129245 | A2 | 12/2006 |
| WO | 2007/042919 | A2 | 4/2007 |
| WO | 2007/060624 | A1 | 5/2007 |
| WO | 2008/065693 | A1 | 6/2008 |
| WO | 2008/102303 | A2 | 8/2008 |
| WO | 2011/145028 | A1 | 11/2011 |
| WO | 2012/059861 | A1 | 5/2012 |

* cited by examiner

MULTICOLOUR LETTERPRESS PRINTING PRESS HAVING NUMBERING CYLINDERS AND AN ADDITIONAL PRINTING

This application is the U.S. national phase of International Application No. PCT/IB2015/050817 filed 3 Feb. 2015 which designated the U.S. and claims priority to EP Patent Application No. 14153895.9 filed 4 Feb. 2014 and EP 14177949.6 filed 22 Jul. 2014, the entire contents of each of which are hereby incorporated by reference.

TECHNICAL FIELD

The present invention generally relates to letterpress printing presses, and more particularly to such printing presses that are used as numbering presses, especially for the production of security documents, such as banknotes.

BACKGROUND OF THE INVENTION

Letterpress printing (also referred to as typography) is a known printing process (see for instance Chapter 2.3, pp. 395-408, of the *"Handbook of Print Media—Technologies and Production Methods"*, Helmut Kipphan (Ed.), ISBN 3-540-67326-1, Springer-Verlag Berlin Heidelberg, 2001).

Letterpress printing is in particular applied in the context of the production of security documents, such as banknotes, for the purpose of numbering the security documents, i.e. providing the security documents with one or more unique serial numbers. Letterpress printing is also typically used in security printing applications for the purpose of providing the security documents with further letterpress features such as a date (e.g. a banknote issuing date), signatures, seals and the like (see also Chapter 2.5.1, pp. 423-433, of the aforementioned handbook, especially the section on pages 427-428, entitled *"Number Printing, Date, and Signatures"*).

Letterpress printing presses and numbering presses are known as such in the art.

Numbering presses are for instance disclosed in European Patent Publications Nos. EP 0 061 795 A1, EP 0 167 196 A1 and in International (PCT) Publications Nos. WO 2006/129245 A2 and WO 2007/060624 A1, which are all in the name of the present Applicant and are incorporated herein by reference in their entirety.

Combined printing presses combining a letterpress printing (e.g. numbering) group and further printing or processing groups are further known in the art. International (PCT) Publication No. WO 2011/145028 A1 in the name of the present Applicant, which is also incorporated herein by reference, for instance discloses a combined numbering and varnishing press. International (PCT) Publications Nos. WO 01/85457 A1, WO 01/85586 A1, WO 2005/008605 A1 and WO 2005/008606 A1, all of which are likewise incorporated herein by reference in their entirety, further disclose variations of a combined inspection and numbering press.

Other numbering presses are also disclosed in European Patent Publications Nos. EP 0 286 317 A1, EP 1 046 498 A1, EP 1 197 332 A1, EP 2 468 506 A1, EP 2 599 631 A1, Japanese Patent Publication No. JP 2000-085095 A and International (PCT) Publications Nos. WO 2006/051563 A1, WO 2008/065693 A1.

FIG. 1 schematically illustrates a known sheet-fed numbering press as previously marketed by the Applicant under the product designation "Super Numerota® 212". A similar illustration can be found on page 428 of the aforementioned *"Handbook of Print Media"*. This numbering press typically comprises a sheet feeder 1 for feeding individual sheets in succession to a letterpress printing group 2, acting as numbering group. Once printed by the letterpress printing group 2, printed sheets are typically transferred to a sheet conveyor system 3 which commonly comprises a plurality of spaced-apart gripper bars driven by a pair of endless chains and designed to hold the sheets by a leading edge thereof. This sheet conveyor system 3 transports the printed sheets along a sheet delivery path to a delivery station 4 where they are delivered onto corresponding delivery piles.

In the illustrated example, the letterpress printing group 2 comprises a two-segment impression cylinder 10 transporting the sheets in succession in front of a first letterpress cylinder, acting as first numbering cylinder, 11.1 and a second letterpress cylinder, acting as second numbering cylinder, 11.2. The numbering cylinders 11.1, 11.2 typically carry a plurality of numbering devices (or numbering boxes) which are arranged in a manner corresponding to the array of individual security prints (e.g. banknote prints) which have been printed on the sheets, prior to being fed on the numbering press. Each individual security print thus receives a unique serial number that is printed twice at distinct locations of the security print.

Each numbering cylinder 11.1, 11.2 is typically inked by a corresponding inking device 12.1, respectively 12.2. The inking devices 12.1, 12.2 supply corresponding inks (which can be different) to the letterpress printing forms of the numbering cylinders 11.1, 11.2 (namely the corresponding printing faces of the relevant numbering wheels of the numbering devices), which in turn transfer the corresponding ink patterns (e.g. in the form of a string of alphanumerical characters) onto the sheets carried by the impression cylinder 10.

FIG. 2 schematically illustrates another known sheet-fed numbering press as currently marketed by the Applicant under the product designation "Super Numerota® III". This numbering press operates according to the same principle as the numbering press of FIG. 1 and likewise comprises a sheet-feeder 1' feeding individual sheets in succession to a letterpress printing group 2', acting as numbering group, to a sheet conveyor system 3' (which likewise comprises a plurality of spaced-apart gripper bars driven by a pair of endless chains and designed to hold the sheets by a leading edge thereof), and then to a sheet delivery station 4' where they are delivered onto corresponding delivery piles.

The letterpress printing group 2' also comprises a two-segment impression cylinder 10' transporting the sheets in succession in front of a first numbering cylinder (first letterpress cylinder) 21.1 and a second numbering cylinder (second letterpress cylinder) 21.2. In this example, each numbering cylinder 21.1, 21.2 is inked by a corresponding inking device 22.1, respectively 22.2, which inking devices 22.1, 22.2 are located in a corresponding inking carriage 20 that can be retracted away from the impression cylinder 10' and the numbering cylinders 21.1, 21.2 during maintenance operations (see also International (PCT) Publications Nos. WO 2006/129245 A2 and WO 2007/060624 A1). In contrast to the numbering press of FIG. 1, the numbering press of FIG. 2 further comprises another letterpress cylinder 23 (in addition to the numbering cylinders 21.1, 21.2) located upstream of the first numbering cylinder 21.1, which letterpress cylinder 23 can for instance be used to print an additional letterpress feature on the sheets (such as a date, a signature, or the like). In contrast to the numbering cylinders 21.1, 21.2, this additional letterpress cylinder 23 can carry a suitable letterpress printing plate on its circumference. A corresponding inking device 24 is further provided to supply the letterpress cylinder 23 with the desired ink.

FIG. 3 shows a variant of the letterpress printing group 2' of FIG. 2. Components of the letterpress printing group 2" shown in FIG. 3 which are common with that of the printing group 2' of FIG. 2 are designated by the same reference numerals and will not be described again.

FIG. 3 shows that the inking device 24' used to supply ink to the letterpress cylinder 23 comprises two ink fountains 24*a*, 24*b* (rather than only one as shown in FIG. 2). The inking devices 22.1, 22.2 could likewise be modified to make use of a double ink fountain arrangement, instead of a single ink fountain 22.1*a*, 22.2*a* as illustrated. Thanks to such double ink fountain arrangements, two (or more) inks can be supplied to the corresponding letterpress cylinder 21.1, 21.2, 23 in order to print multicolour features. In particular, a first portion of the serial numbers could be inked with one ink colour, while a remaining portion of the serial numbers could be inked with another, different ink colour. With such an inking configuration, a colour-split is however only possible in the axial direction, i.e. along the direction of the axes of rotation of the cylinders 10, 21.1, 21.2, 23.

European Patent Publication No. EP 0 291 159 A1 discloses a multicolour offset printing press of the type comprising a printing group equipped with a plate cylinder carrying a letterpress printing plate, which letterpress printing plate is inked with a multicolour ink pattern transferred from an ink-collecting cylinder. This ink-collecting cylinder (also referred to in the art as "Orlof cylinder") collects different ink patterns from multiple chablon cylinders (or "colour-selection cylinders") that are distributed about the circumference of the ink-collecting cylinder, each chablon cylinder carrying a chablon plate with relief portions that are inked by an associated inking device. This printing process is known in the art as "Orlof-offset printing" and only involves collecting of multiple ink patterns on the ink-collecting cylinder for transfer onto a single plate cylinder, which then transfers the resulting multicolour pattern of inks onto the substrate to be printed via a blanket cylinder.

Other offset printing presses adapted to perform "Orlof-offset printing" are also known from European Patent Publications Nos. EP 0 132 858 A1, EP 0 343 105 A2, EP 0 343 106 A2, EP 0 343 107 A2 or International (PCT) Publication No. WO 2007/042919 A2.

SUMMARY OF THE INVENTION

A general aim of the invention is to provide a letterpress printing press, which can in particular be used as numbering press, with improved functionalities.

These aims are achieved thanks to the printing presses defined in independent claim 1.

There is accordingly provided a letterpress printing press, in particular a numbering press, comprising a printing group with at least a first letterpress cylinder and a second letterpress cylinder which are inked by an associated inking system. The inking system comprises (i) a first inking device supplying ink to a first chablon cylinder, (ii) at least a second inking device supplying ink to a second chablon cylinder, and (iii) an ink-collecting cylinder contacting the first and second chablon cylinders and the first and second letterpress cylinders. The ink-collecting cylinder collects a first ink pattern from the first chablon cylinder and a second ink pattern from the second chablon cylinder, thereby forming a first multicolour pattern of inks on the ink-collecting cylinder which is transferred onto the first letterpress cylinder. The ink-collecting cylinder further collects a third ink pattern from the first chablon cylinder and a fourth ink pattern from the second chablon cylinder, thereby forming a second multicolour pattern of inks on the ink-collecting cylinder, which second multicolour pattern of inks is transferred onto the second letterpress cylinder.

Preferably, an angle formed between a plane intersecting the axis of rotation of the first chablon cylinder and the axis of rotation of the ink-collecting cylinder and a plane intersecting the axis of rotation of the second chablon cylinder and the axis of rotation of the ink-collecting cylinder is substantially of 90°.

Similarly, an angle formed between a plane intersecting the axis of rotation of the first letterpress cylinder and the axis of rotation of the ink-collecting cylinder and a plane intersecting the axis of rotation of the second letterpress cylinder and the axis of rotation of the ink-collecting cylinder is preferably substantially of 90°.

In accordance with a preferred embodiment of the invention, the first chablon cylinder, the second chablon cylinder, the first letterpress cylinder and the second letterpress cylinder are each mounted on a single eccentric, while the ink-collecting cylinder is mounted on a double eccentric.

In the context of the invention, the first and second letterpress cylinders may in particular cooperate with a common impression cylinder.

In accordance with another preferred embodiment of the invention, at least one (advantageously both) of the first and second inking devices each include two inking units.

In accordance with yet another embodiment of the invention, the letterpress printing press may further comprise an additional printing unit located upstream of the first letterpress cylinder, the first letterpress cylinder and the additional printing unit preferably cooperating with a same impression cylinder. In this particularly preferred context, an intermediate drying or curing unit may conveniently be omitted between the additional printing unit and the first letterpress cylinder.

In the context of the aforementioned embodiment, the additional printing unit can in particular be a screen printing unit, which screen printing unit can furthermore be adapted to apply an ink containing pigment flakes that can be orientated by means of a magnetic field, in which case the letterpress printing press further comprises a magnetic-field-generating unit located downstream of the screen printing unit for subjecting the ink applied by the screen printing unit to a magnetic field with a view to orientate the pigment flakes contained therein, prior to a drying or curing operation.

The letterpress printing press can furthermore conveniently be further provided with an inspection unit located upstream of the printing group. Similarly, the letterpress printing press can also further comprise an inspection system located within the printing group for inspecting features printed by the printing group.

In addition, in accordance with a further refinement of the invention, the first and second inking devices are preferably supported in a movable inking carriage that is retractable away from a stationary machine frame of the letterpress printing press and the first and second chablon cylinders are, similarly, preferably supported, together with the ink-collecting cylinder, in a movable intermediate carriage that is interposed between the inking carriage and the printing group and is likewise retractable away from the stationary machine frame of the letterpress printing press.

The letterpress printing press of the invention can in particular be designed to operate as a numbering press, the first and second letterpress cylinders being numbering cylinders carrying a plurality of numbering devices.

Further advantageous embodiments of these printing presses form the subject-matter of the dependent claims and are discussed below.

BRIEF DESCRIPTION OF THE DRAWINGS

Other features and advantages of the present invention will appear more clearly from reading the following detailed description of embodiments of the invention which are presented solely by way of non-restrictive examples and illustrated by the attached drawings in which.

DETAILED DESCRIPTION OF EMBODIMENTS OF THE INVENTION

The present invention will be described in the particular context of a sheet-fed numbering press as used for the production of banknotes and like security documents. It should however be appreciated that the present invention is applicable irrespective of the type of substrate being printed (individual sheets, continuous web, individual documents, etc.). Furthermore, while the invention is particularly suitable for numbering security documents, it can also be applied more generally for the purpose of printing any feature by way of a letterpress (typographic) printing principle.

Within the context of the present invention, the expression "letterpress printing" encompasses, but is not limited to "numbering". Likewise, the expression "letterpress cylinder" is a generic expression which encompasses, but is not limited to the notion "numbering cylinder".

Figure 1:
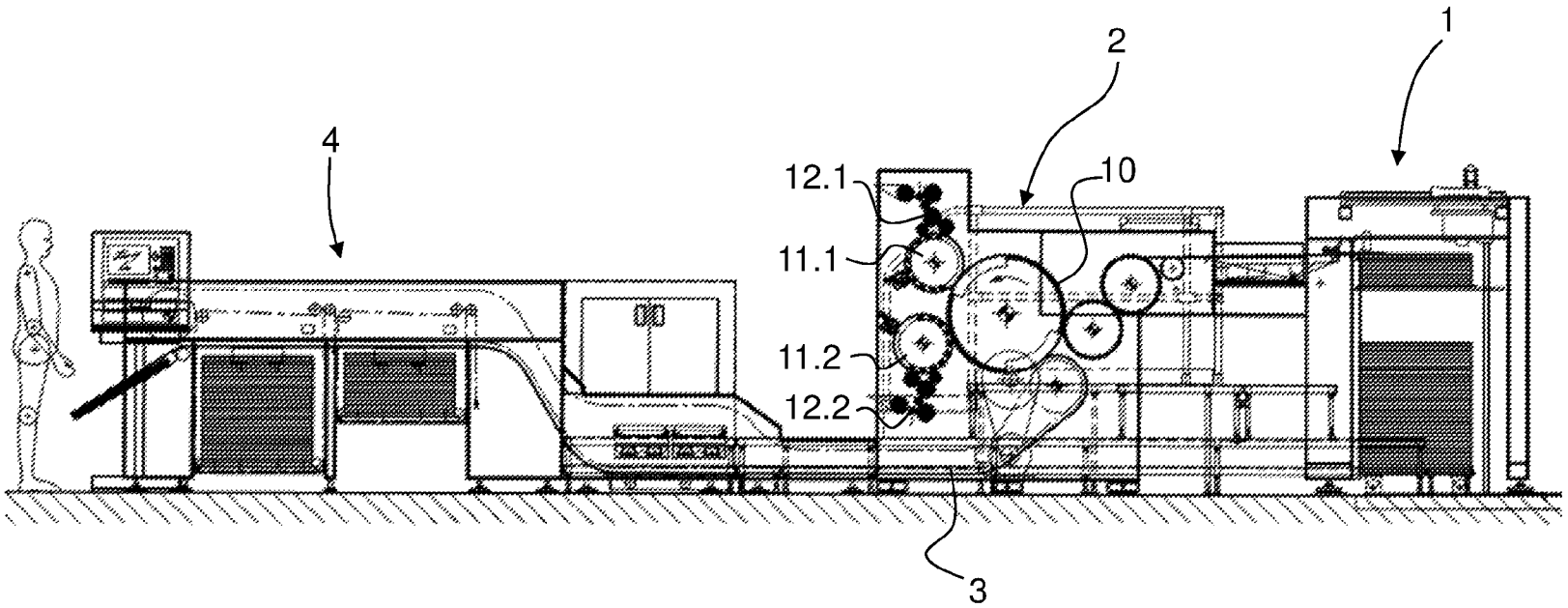
Fig. 1 (PRIOR ART)
FIG. 1 is a schematic side view of a known sheet-fed numbering press as marketed by the Applicant under the product designation "Super Numerota® 212"
Figure 2:
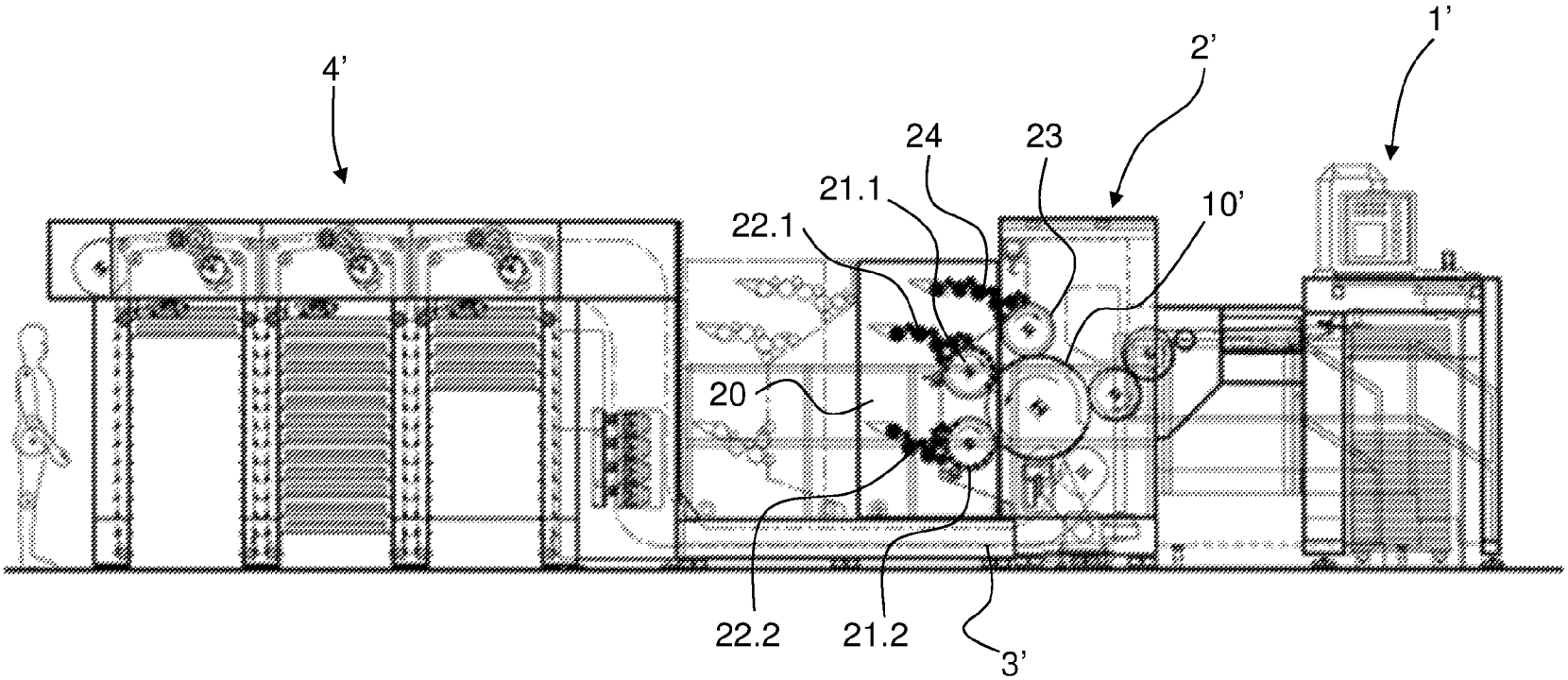
Fig. 2 (PRIOR ART)
FIG. 2 is a schematic side view of another known sheet-fed numbering press as marketed by the Applicant under the product designation "Super Numerota® III"
Figure 3:
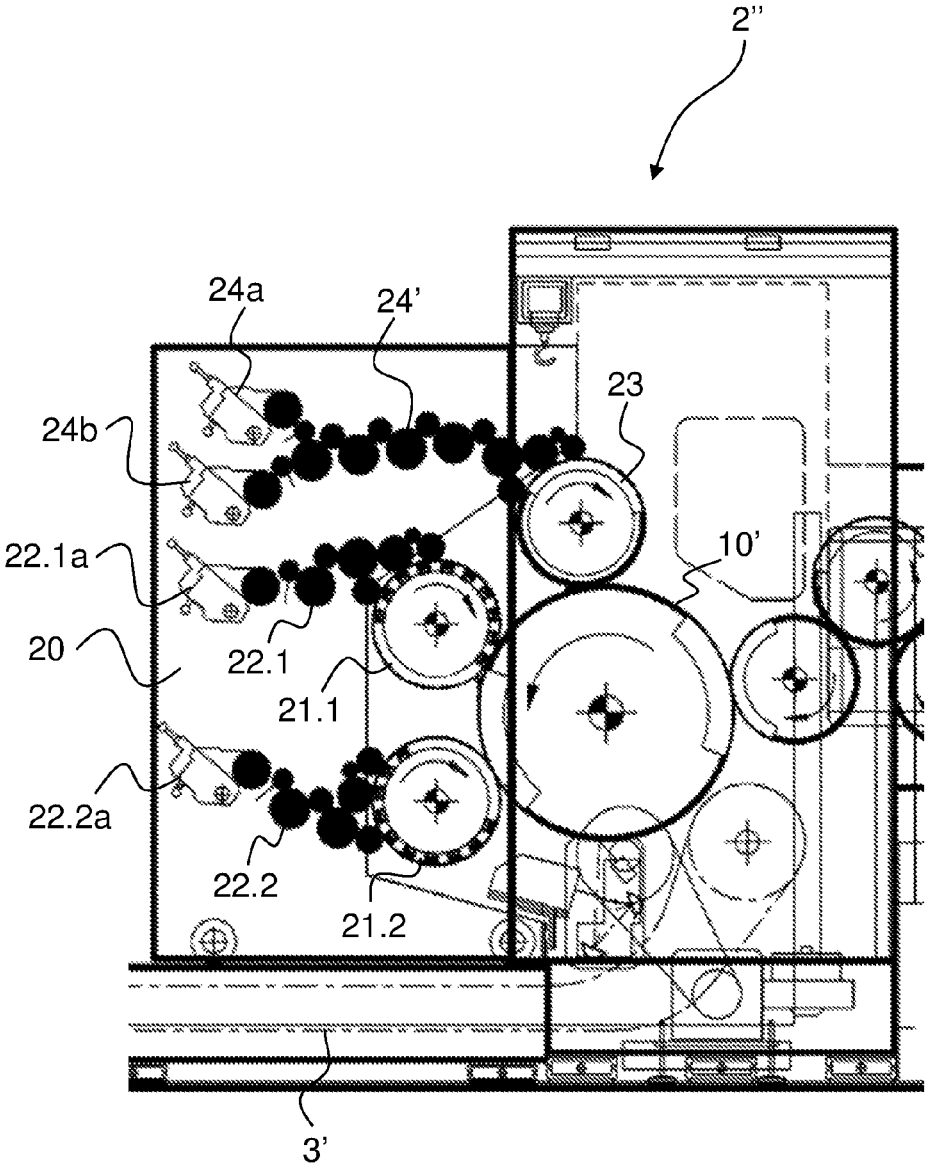
Fig. 3 (PRIOR ART)
FIG. 3 is a schematic partial side view of a variant of the printing group of the numbering press of FIG. 2.
Figure 4:
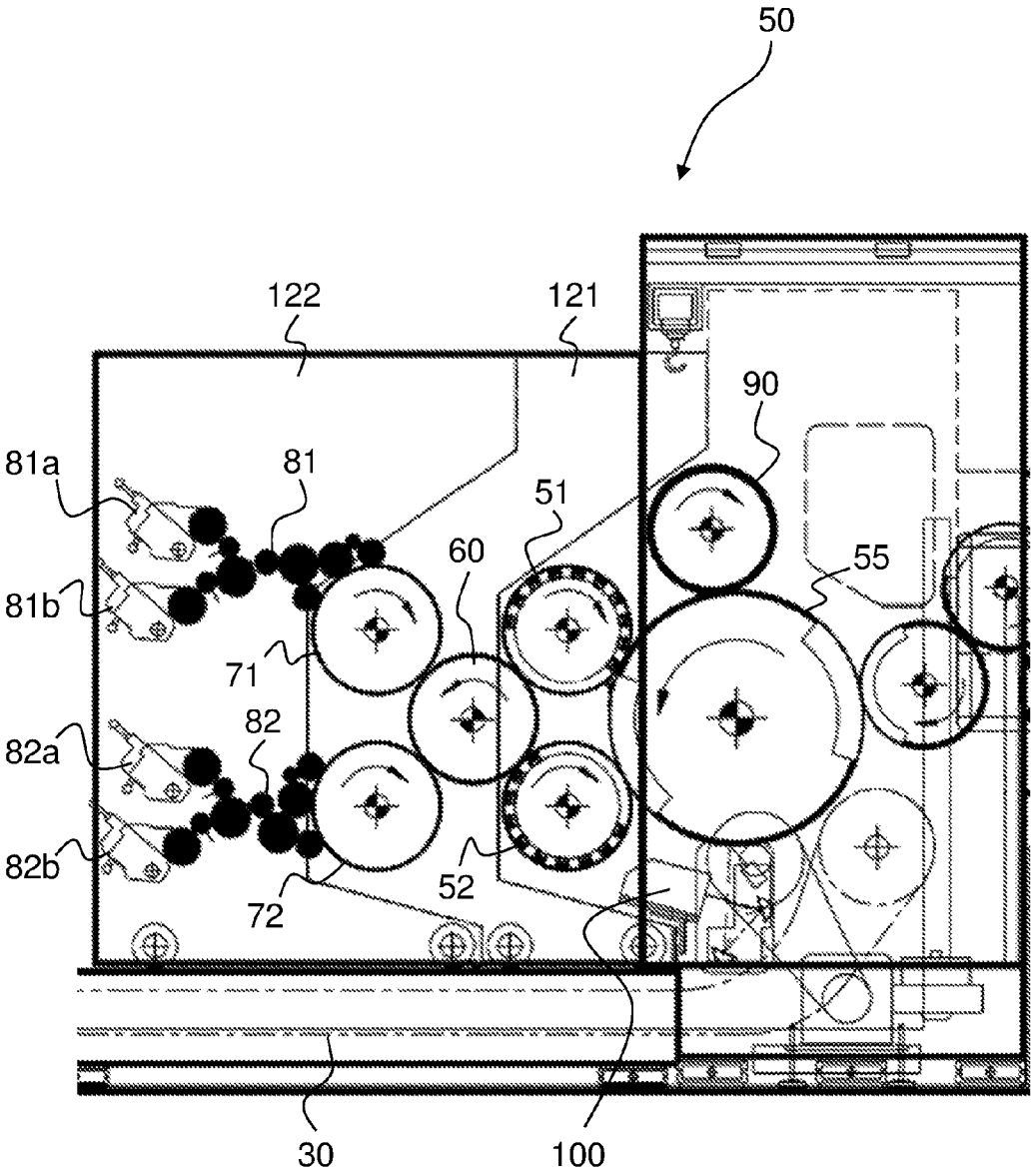
FIG. 4 is a schematic partial side view of a printing group of a numbering press in accordance with one embodiment of the invention, which printing group includes an ink-collecting cylinder for collecting inks of different colours prior to transfer thereof onto the downstream-located letterpress/numbering cylinder(s)

FIG. 4 is a schematic partial side view of a printing group 50 of a letterpress printing press, namely a numbering press, in accordance with one embodiment of the invention.

In the illustrated example, the printing group 50 includes an impression cylinder 55 and two numbering (letterpress) cylinders 51, 52 cooperating with the impression cylinder 55. An optional, additional printing unit 90 located upstream of the first numbering cylinder 51 also cooperates with the impression cylinder 55. This additional printing unit 90 can be any suitable printing unit, such as an additional letterpress printing unit. In the present example, the two numbering cylinders 51, 52 each carry a set of numbering boxes, as such known in the art.

In accordance with a first aspect of the invention, the first numbering cylinder 51 is inked by an associated inking system comprising the elements designated in FIG. 4 by reference numerals 60, 71, 72, 81, 81*a*, 81*b*, 82, 82*a* and 82*b*. More precisely, the inking system comprises:

- a first inking device 81 supplying ink to a first chablon cylinder 71;
- (at least) a second inking device 82 supplying ink to a second chablon cylinder 72; and
- an ink-collecting cylinder (or "Orlof" cylinder) 60 contacting the first and second chablon cylinders 71, 72.

The first and second chablon cylinders 71, 72 each carry a chablon plate with relief portions that are designed to transfer ink only in selected portions to the circumference of the ink-collecting cylinder 60.

Figure 8:
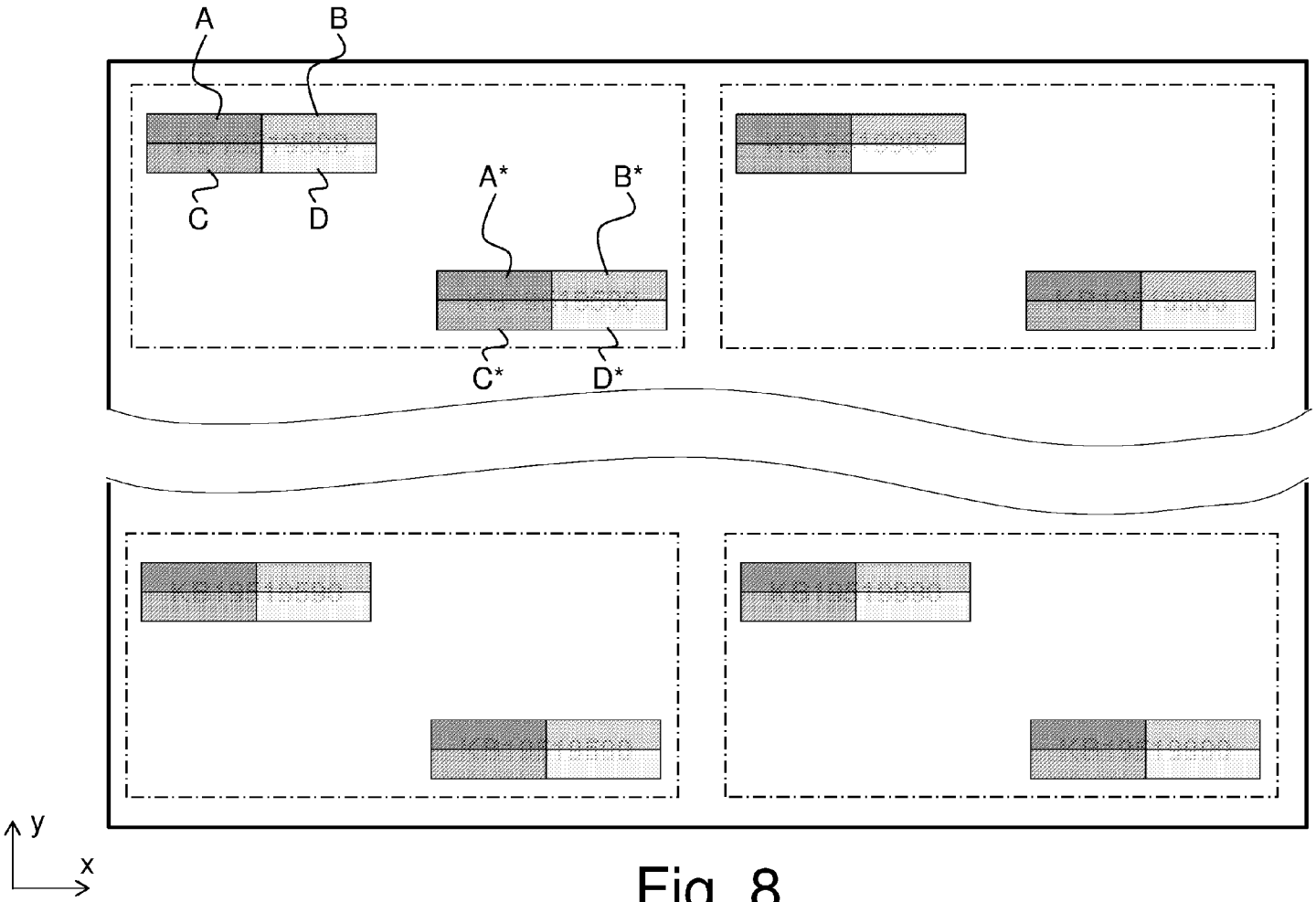
FIG. 8 is a schematic illustration of possible multicolour patterns of inks as collected on the surface of the ink-collecting cylinder shown in FIGS. 4 to 6.
Figure 9:
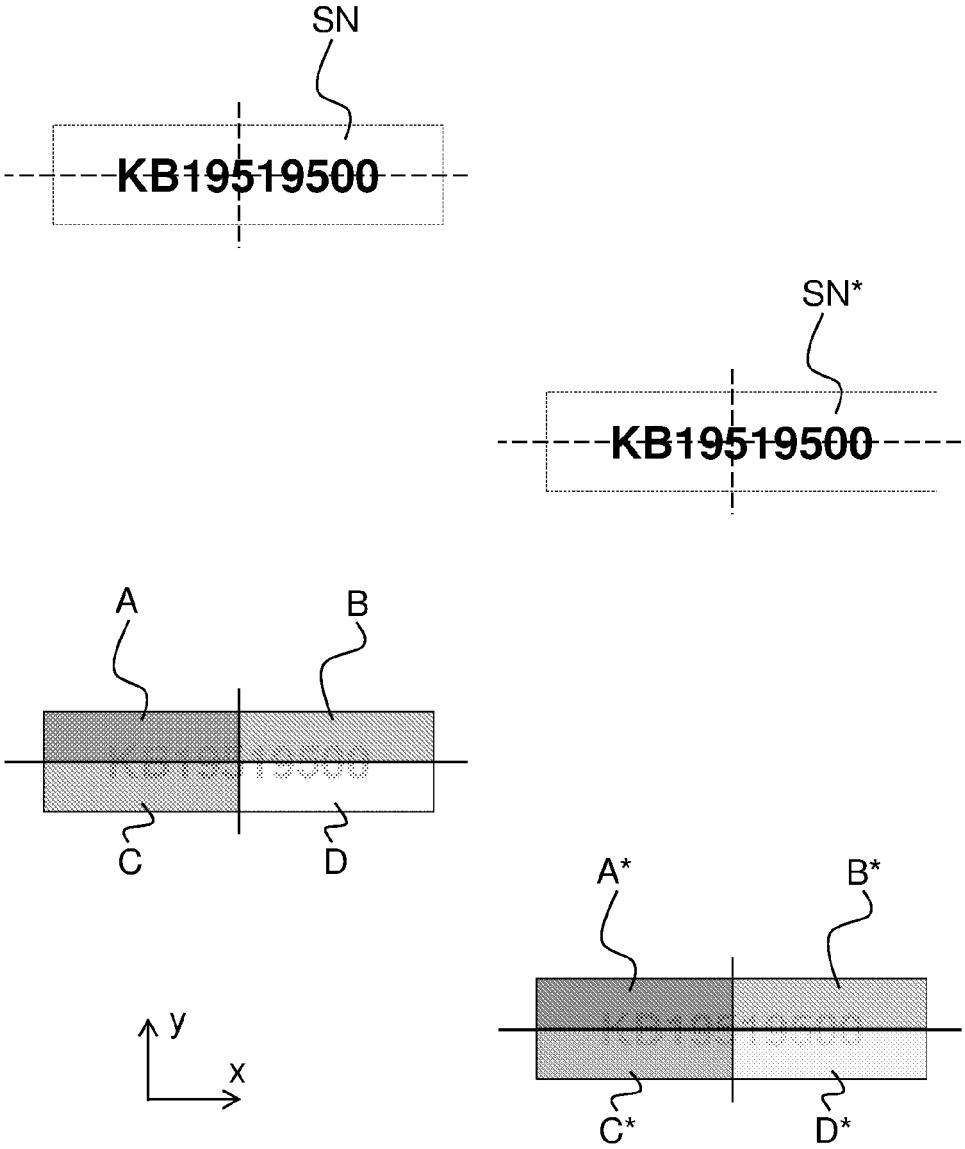
FIG. 9 is a schematic illustration of the resulting split into four coloured areas.

The ink-collecting cylinder 60 is designed to collect a first ink pattern from the first chablon cylinder 71 (which first ink pattern may for instance include the ink pattern formed of ink fields A and D shown by way of illustration in FIGS. 8 and 9) and a second ink pattern from the second chablon cylinder 72 (which second ink pattern may for instance include the ink pattern formed of ink fields B and C shown in FIGS. 8 and 9), thereby forming a first multicolour pattern of inks on the ink-collecting cylinder 60 which is transferred onto the first numbering cylinder 51. In the illustrative example of FIGS. 8 and 9, this first multicolour pattern of inks consists of four adjacent ink fields A to D.

The ink-collecting cylinder 60 is also designed to collect a third ink pattern from the first chablon cylinder 71 (which third ink pattern may for instance include the ink pattern formed of ink fields A* and D* shown in FIGS. 8 and 9) and a fourth ink pattern from the second chablon cylinder 72 (which fourth ink pattern may for instance include the ink pattern formed of ink fields B* and C* shown in FIGS. 8 and 9), thereby forming a second multicolour pattern of inks on the ink-collecting cylinder 60, which is transferred onto the second numbering cylinder 52. In the illustrative example of FIGS. 8 and 9, this second multicolour pattern of inks consists of four adjacent ink fields A* to D*.

As illustrated in the preferred embodiment of FIG. 4, the ink-collecting cylinder 60 is in direct contact with both the first and second numbering cylinders 51, 52.

In addition, at least one, preferably both (as illustrated), of the first and second inking devices 81, 82 include two inking units, namely ink fountains 81*a*, 81*b*, respectively 82*a*, 82*b*. For the sake of the illustration, it will be assumed that the ink supplied by ink fountain 81*a* is used to ink fields A and A* shown in FIGS. 8 and 9, while the ink supplied by ink fountain 81*b* is used to ink fields D and D*. Similarly, it will be assumed that the ink supplied by ink fountain 82*a* is used to ink fields B and B* shown in FIGS. 8 and 9, while the ink supplied by ink fountain 82*b* is used to ink fields C and C*.

The impression cylinder 55 and numbering cylinders 51, 52 (as well as the optional printing unit 90) are preferably supported in a stationary machine frame, while the ink-collecting cylinder 60, the chablon cylinders 71, 72 and the inking devices 81, 82 are preferably supported onto at least one mobile carriage that can be retracted away from the stationary machine frame. In the illustrated example, the ink-collecting cylinder 60 and the chablon cylinders 71, 72 are preferably supported in an intermediate carriage 121, while the inking devices 81, 82 are supported in a separate inking carriage 122, both carriages 121, 122 being retractable away from the stationary machine frame of the letterpress printing press. This particular configuration allows proper and direct access to the chablon cylinders 71, 72, the ink-collecting cylinder 60 and the numbering cylinders 51, 52, which greatly facilitates maintenance operations, such as mounting of numbering boxes on cylinders 51, 52, replacement of blankets on ink-collecting cylinder 60, or replacement of chablon plates on chablon cylinders 71, 72.

As illustrated in FIG. 4, an inspection system 100 is further provided inside the printing group 50 for inspecting features printed by the printing group 50. This inspection system 100 preferably cooperates with the impression cylinder 55, i.e. right after the second numbering cylinder 52. This inspection system can in particular be used for the purpose of checking the quality of the numbering. In the particular instance, the inspection system 100 includes a line-scan camera which looks at the surface of the printed sheets being transported by the impression cylinder 55 via a combination of two mirrors (not referenced) that allow proper redirection of the optical path of the camera.

Figure 5:
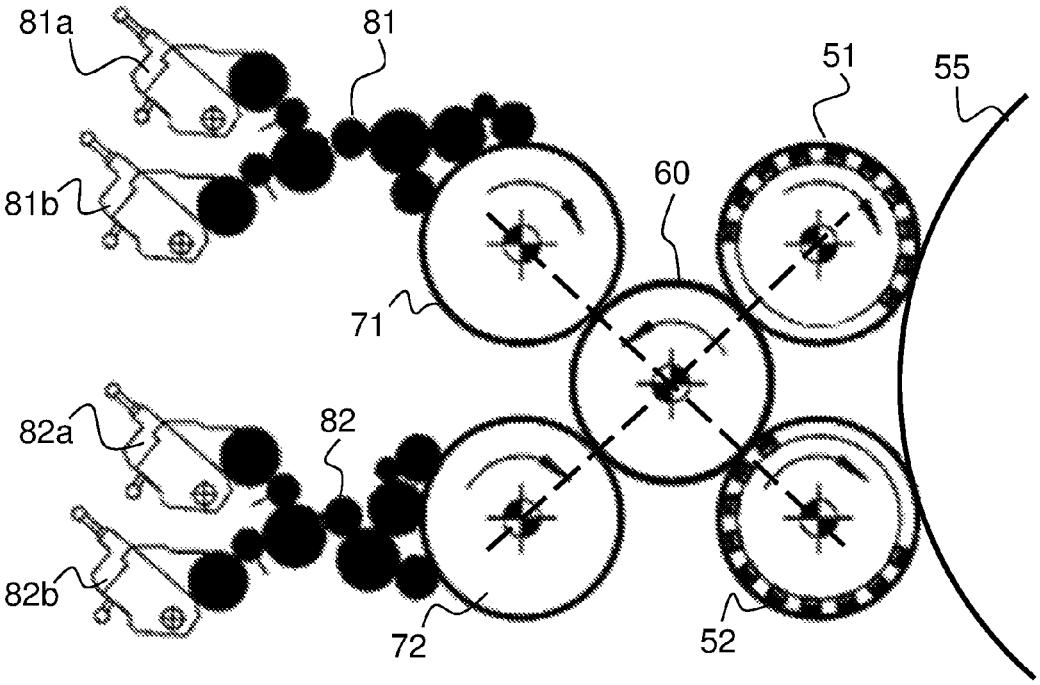
FIG. 5 is a schematic view of the cylinder arrangement of FIG. 4.

FIG. 5 is a schematic view of the cylinder arrangement of FIG. 4 where only relevant components are illustrated, namely the impression cylinder 55 (partly), the first and second numbering cylinders 51, 52, the ink-collecting cylinder 60, the first and second chablon cylinders 71, 72 and the inking devices 81, 82.

It is apparent from looking at FIG. 5 that an angle formed between a plane intersecting the axis of rotation of the first chablon cylinder 71 and the axis of rotation of the ink-collecting cylinder 60 and a plane intersecting the axis of rotation of the second chablon cylinder 72 and the axis of rotation of the ink-collecting cylinder 60 (which two planes are depicted by dashed lines in FIG. 5) is substantially of 90° in this preferred embodiment.

Similarly, an angle formed between a plane intersecting the axis of rotation of the first numbering cylinder 51 and the axis of rotation of the ink-collecting cylinder 60 and a plane intersecting the axis of rotation of the second numbering cylinder 52 and the axis of rotation of the ink-collecting cylinder 60 is substantially of 90° in this preferred embodiment.

The first chablon cylinder 71, the second chablon cylinder 72, the first letterpress cylinder 51 and the second letterpress cylinder 52 are each preferably mounted on a single eccentric. In contrast, the ink-collecting cylinder 60 is preferably mounted on a double eccentric.

Figure 7:
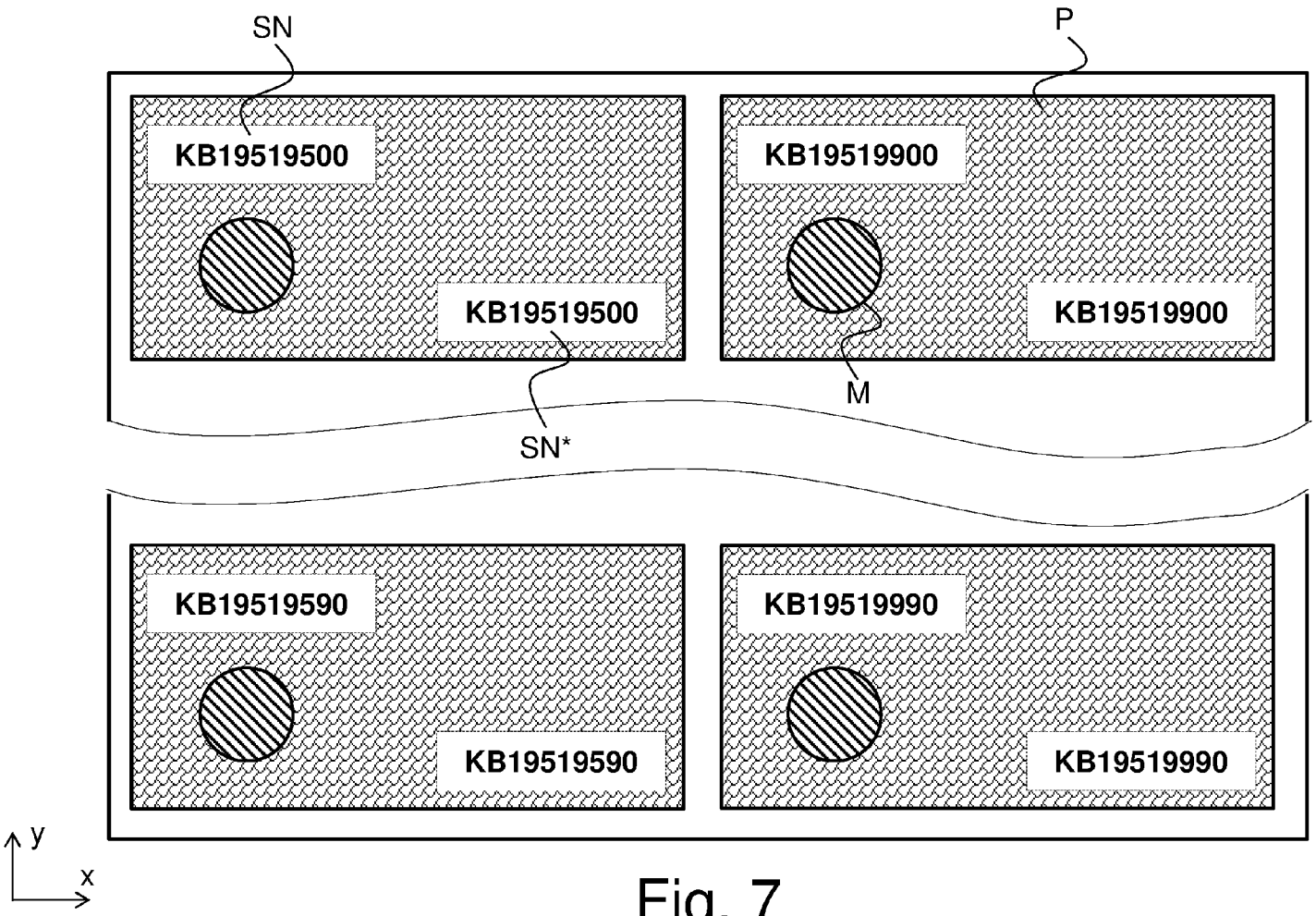
FIG. 7 is a schematic illustration of a sheet carrying security imprints which are each provided with a pair of unique serial numbers in accordance with the invention.

An illustrative example of the features that can be realized thanks to the printing press of the invention is described in reference to FIGS. 7 to 9.

FIG. 7 is a schematic illustration of a sheet carrying security imprints P which are each provided with a pair of unique serial numbers SN, SN* in accordance with the invention. Only four security imprints P are shown in FIG. 7 for the sake of simplicity. It will however be appreciated that sheets of securities typically include a matrix arrangement of multiple security imprints P organized in multiple rows and columns. Each pair of serial numbers SN, SN* is unique to each security imprint P.

FIG. 7 further shows an additional printed pattern designated by reference M which is printed outside of the locations where the two serial numbers SN, SN* are provided. This additional printed pattern M can be applied by way of the additional printing unit 90 of FIG. 4 (such as the screen printing unit 95 of FIG. 6).

FIG. 8 is a schematic illustration of possible multicolour patterns of inks as collected on the surface of the ink-collecting cylinder 60 shown in FIGS. 4 and 5 (or 6). Thanks to the invention, each serial number SN, SN* can be printed with a more complex patterns of inks than this was possible with the known numbering presses. More precisely, as schematically depicted in FIG. 8, each serial number SN, SN* can be inked with a multicolour pattern of inks exhibiting a more complex colour split in both the horizontal (axial) direction x and the vertical (circumferential) direction y.

In the illustrated example, a first multicolour pattern of inks, associated to serial number SN, is formed on the ink-collecting cylinder 60 and consists of four coloured regions A, B, C and D. Likewise, a second multicolour pattern of inks, associated to serial number SN*, is formed on the ink-collecting cylinder 60 and consists of four coloured regions A*, B*, C* and D*. While the colour split of both multicolour patterns A-D and A*-D* is the same in the illustrated example, the two serial numbers SN, SN* could alternatively be inked with distinct ink patterns.

FIG. 9 is a schematic illustration of the resulting split of the serial numbers SN, SN* into four coloured areas A-D, respectively A*-D*. In this example, the colour split is performed both in the horizontal direction x and the vertical direction y, leading to the serial numbers SN, SN* being printed with four portions A, B, C, D, respectively A*, B*, C*, D* of distinct colours. Other colour splits are possible, depending on the particular design of the chablon plates used on the chablon cylinders 71, 72.

Figure 6:
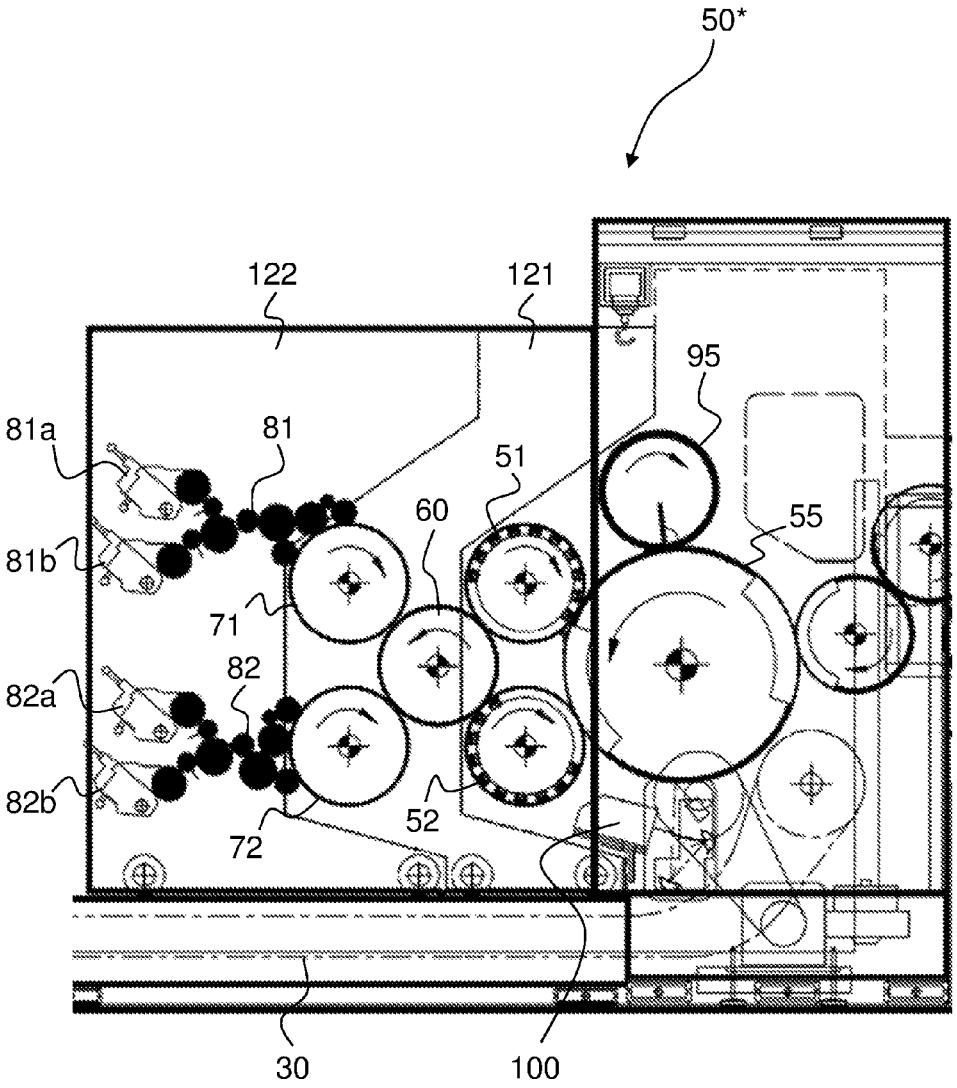
FIG. 6 is a schematic partial side view of a printing group of a numbering press in accordance with another embodiment of the invention, which printing group likewise includes an ink-collecting cylinder for collecting inks of different colours.

FIG. 6 is a schematic partial side view of a printing group 50* of a letterpress printing press, namely a numbering press, in accordance with another embodiment of the invention, which printing group 50* likewise includes an ink-collecting cylinder 60 for collecting inks of different colours.

The difference with respect to the first embodiment discussed in reference to FIGS. 4 and 5 resides in the fact that the printing group 50* comprises a screen printing unit 95 located upstream of the first letterpress cylinder 51 (which screen printing unit 95 preferably cooperates with the impression cylinder 55).

This particular arrangement of the screen printing unit 95 allows for the application of an additional printed pattern (see FIG. 7 where this pattern is designated by reference M), such as a pattern of Optically Variable Ink (OVI) or Optically Variable Magnetic Ink (OVMI). It will be appreciated that the screen printing unit 95 is designed to apply this additional printed pattern M in an area of the security documents which is selected to be located outside of the region where the serial numbers SN, SN* are to be applied (see again FIG. 7). Thanks to this configuration, no intermediate drying or curing unit is necessary between the screen printing unit 95 and the first letterpress cylinder 51. A drying or curing unit may nevertheless be optionally provided downstream of the printing unit 95 should this be required or useful.

Figure 11:
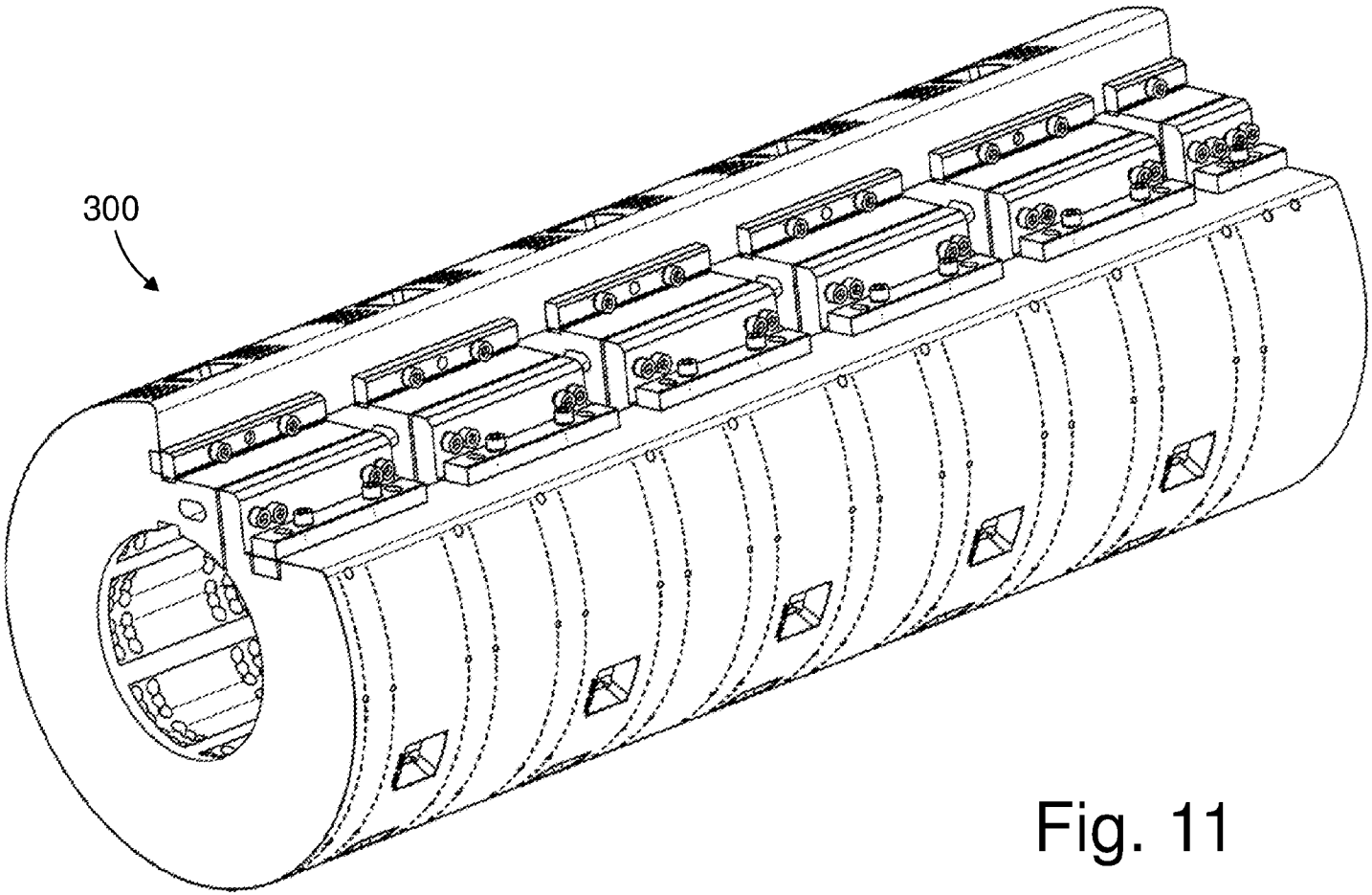
FIG. 11 is a schematic perspective view of a portion of a cylinder body as taught in International (PCT) Publication No. WO 2008/102303 A2, which cylinder body can be used as magnetic-field-generating unit in the context of a preferred embodiment of the invention as discussed e.g. in relation to FIG. 6 hereof.

Preferably, the screen printing unit 95 is adapted to apply an ink containing pigment flakes that can be oriented by means of a magnetic field (i.e. a so-called Optically Variable Magnetic Ink, or OVMI) and the letterpress printing press further comprises a magnetic-field-generating unit located downstream of the screen printing unit 95 for subjecting the ink applied by the screen printing unit 95 to a magnetic field with a view to orientate the pigment flakes contained therein, prior to a drying or curing operation. A suitable magnetic-field-generating unit is disclosed in International (PCT) Publication No. WO 2008/102303 A2, which unit can conveniently be located along the path of the sheet conveyor system 30 in FIG. 6. FIG. 11 is a schematic perspective view of a portion of a cylinder body 300 as discussed in greater detailed in International (PCT) Publication No. WO 2008/102303 A2, which cylinder body 300 can suitably be used as magnetic-field-generating unit in the context of the present invention (see also European Patent Publication No. EP 2 433 798 A1).

Figure 10:
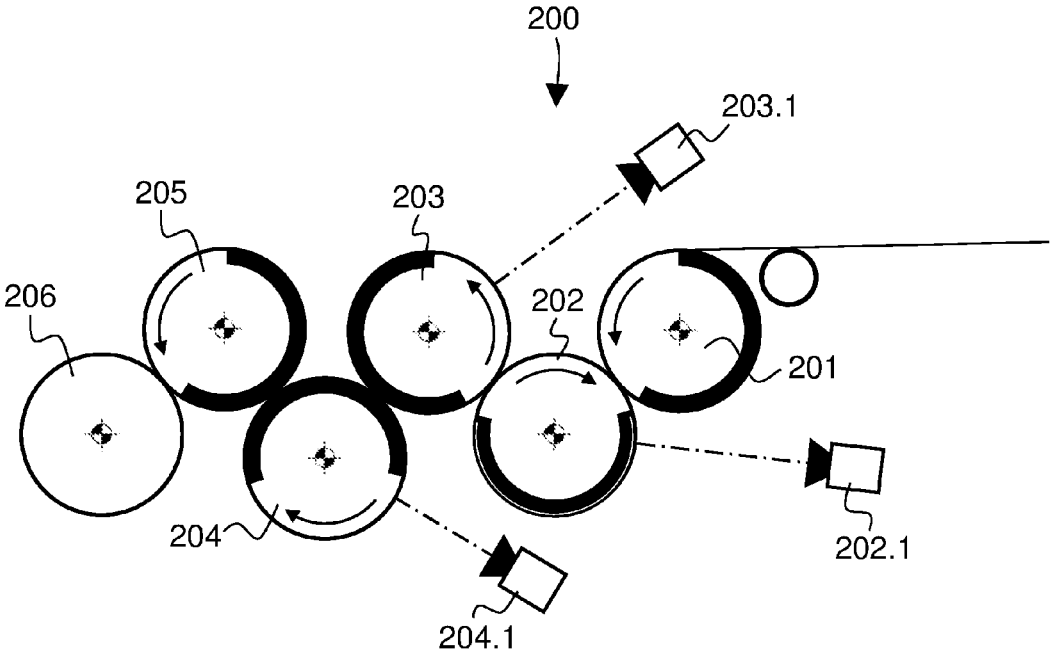
FIG. 10 is a schematic illustration of a possible inspection unit that could conveniently be located upstream of the printing group of the letterpress printing press of the invention in order to inspect the sheets prior to being fed to the printing group.

As a further refinement, it may be contemplated to combine the printing group 50, 50* discussed above with an inspection unit located upstream of the printing group 50, 50* (as for instance disclosed in International (PCT) Publication Nos. WO 2005/008605 A1, WO 2005/008606 A1 and WO 2012/059861 A1, which are incorporated herein by reference) in order to inspect the sheets prior to transferring them to the printing group 50, 50*. This in particular allows e.g. full-sheet numbering of only those sheets that meet certain quality requirements. An example of a possible inspection unit 200 is shown in FIG. 10, where reference numerals 201 to 206 designate individual sheet transfer cylinders and reference numerals 202.1, 203.1 and 204.1 designate individual optical inspection cameras—such as line-scan cameras—associated to transfer cylinders 202, 203 and 204, respectively, for inspection of the sheets. In this context, each transfer cylinder 202, 203, 204 forms, with the associated inspection camera 202.1, 203.1, 204.1, respectively, a corresponding inspection unit, in particular a front-side inspection unit for inspecting the front side of the sheets under reflected light, a reverse-side inspection unit for inspecting the reverse side of the sheets under reflected light, and a transparency inspection unit for inspecting the sheets in transparency. Once inspected by the inspection unit 200, the inspected sheets can for instance be transferred directly from transfer cylinder 206 to the impression cylinder 55 of the aforementioned printing group 50, 50*.

Various modifications and/or improvements may be made to the above-described embodiments without departing from the scope of the invention as defined by the annexed claims.

In particular, while the embodiments discussed above relate to numbering presses, the invention is generally applicable to any letterpress printing press. In addition the invention is not limited to sheet-fed printing presses.

LIST OF REFERENCE NUMERALS USED THEREIN

1, 1' sheet feeder
2, 2', 2" letterpress printing group/numbering group
3, 3' sheet conveyor system (e.g. chain gripper system with spaced-apart gripper bars driven by endless chains)
4, 4' sheet delivery station
10, 10' impression cylinder
11.1, 11.2 letterpress cylinder/numbering cylinder
12.1, 12.2 inking device of letterpress printing (numbering) cylinder 11.1, resp. 11.2
20 retractable inking carriage (supporting inking devices 22.1, 22.2, 24)
21.1, 21.2 letterpress cylinder/numbering cylinder
22.1, 22.2 inking device of letterpress printing (numbering) cylinder 21.1, resp. 21.2
22.1*a*, 22.2*a* ink fountain of inking device 22.1, resp. 22.2
23 (optional) letterpress cylinder (e.g. for printing a date, signature, seal, etc.)
24, 24' inking device of letterpress cylinder 23
24*a*', 24*b*' (double) ink fountains of inking device 24'
30 sheet conveyor system (e.g. chain gripper system with spaced-apart gripper bars driven by endless chains)
50, 50* printing group
51, 52 letterpress cylinder/numbering cylinder
60 ink-collecting cylinder
71, 72 chablon cylinder
81, 82 inking device supplying ink to chablon cylinder 71, resp. 72
81*a*, 81*b* (double) ink fountains of inking device 81
82*a*, 82*b* (double) ink fountains of inking device 82
90 optional printing cylinder
95 screen printing unit
100 inspection system
121 intermediate carriage supporting the ink-collecting cylinder 60 and the chablon cylinders 71, 72
122 inking carriage supporting the inking devices 81, 82
200 inspection unit located upstream of printing group 50, 50* (see e.g. International (PCT) Publications Nos. WO 2005/008605 A1, WO 2005/008606 A1 and WO 2012/059861 A1)
201-206 sheet transfer cylinders
202.1 inspection camera cooperating with sheet transfer cylinder 202 and forming e.g. a transparency inspection unit for inspecting the sheets in transparency
203.1 inspection camera cooperating with sheet transfer cylinder 203 and forming e.g. a front-side inspection unit for inspecting the front side of the sheets under reflected light
204.1 inspection camera cooperating with sheet transfer cylinder 204 and forming e.g. a reverse-side inspection unit for inspecting the reverse side of the sheets under reflected light
300 magnetic-field-generating unit (see e.g. International (PCT) Publication No. WO 2008/102303 A2 and European Patent Publication No. EP 2 433 798 A1)
P security print (e.g. banknote imprint)
SN, SN* serial number
A-D ink fields coordinated with the area of serial number SN
A*-D* ink fields coordinated with the area of serial number SN*
M printed pattern applied by e.g. screen printing unit 95

The invention claimed is:

1. A letterpress printing press, in particular a numbering press, comprising a printing group with at least a first letterpress cylinder and a second letterpress cylinder which are inked by an associated inking system, wherein the inking system comprises:

a first inking device supplying ink to a first chablon cylinder;

at least a second inking device supplying ink to a second chablon cylinder; and an ink-collecting cylinder contacting the first and second chablon cylinders and the first and second letterpress cylinders, wherein the ink-collecting cylinder collects a first ink pattern from the first chablon cylinder and a second ink pattern from the second chablon cylinder, thereby forming a first multicolour pattern of inks on the ink-collecting cylinder, which first multicolour pattern of inks is transferred onto the first letterpress cylinder, and wherein the ink-collecting cylinder further collects a third ink pattern from the first chablon cylinder and a fourth ink pattern from the second chablon cylinder, thereby forming a second multicolour pattern of inks on the ink-collecting cylinder, which second multicolour pattern of inks is transferred onto the second letterpress cylinder.

2. The letterpress printing press according to claim 1, wherein an angle formed between a plane intersecting the axis of rotation of the first chablon cylinder and the axis of rotation of the ink-collecting cylinder and a plane intersecting the axis of rotation of the second chablon cylinder and the axis of rotation of the ink-collecting cylinder is substantially of 90°.

3. The letterpress printing press according to claim 1, wherein an angle formed between a plane intersecting the axis of rotation of the first letterpress cylinder and the axis of rotation of the ink-collecting cylinder and a plane intersecting the axis of rotation of the second letterpress cylinder and the axis of rotation of the ink-collecting cylinder is substantially of 90°.

4. The letterpress printing press according to claim 1, wherein the first chablon cylinder, the second chablon cylinder, the first letterpress cylinder and the second letterpress cylinder are each mounted on a single eccentric, while the ink-collecting cylinder is mounted on a double eccentric.

5. The letterpress printing press according to claim 1, wherein the first and second letterpress cylinders cooperate with a common impression cylinder.

6. The letterpress printing press according to claim 1, wherein at least one of the first and second inking devices includes two inking units.

7. The letterpress printing press according to claim 6, wherein both of the first and second inking devices each include two inking units.

8. The letterpress printing press according to claim 1, further comprising an additional printing unit located upstream of the first letterpress cylinder.

9. The letterpress printing press according to claim 8, wherein the first letterpress cylinder and the additional printing unit cooperate with a same impression cylinder.

10. The letterpress printing press according to claim 9, wherein no intermediate drying or curing unit is provided between the additional printing unit and the first letterpress cylinder.

11. The letterpress printing press according to claim 8, wherein the additional printing unit is a screen printing unit.

12. The letterpress printing press according to claim 11, wherein the screen printing unit is adapted to apply an ink containing pigment flakes that can be orientated by means of a magnetic field and wherein the letterpress printing press further comprises a magnetic-field-generating unit located downstream of the screen printing unit for subjecting the ink applied by the screen printing unit to a magnetic field with a view to orientate the pigment flakes contained therein, prior to a drying or curing operation.

13. The letterpress printing press according to claim 1, further comprising an inspection unit located upstream of the printing group.

14. The letterpress printing press according to claim 1, further comprising an inspection system located within the printing group for inspecting features printed by the printing group.

15. The letterpress printing press according to claim 1, wherein the first and second inking devices are supported in a movable inking carriage that is retractable away from a stationary machine frame of the letterpress printing press and wherein the first and second chablon cylinders are supported together with the ink-collecting cylinder in a movable intermediate carriage that is interposed between the inking carriage and the printing group and is likewise retractable away from the stationary machine frame of the letterpress printing press.

16. The letterpress printing press according to claim 1, wherein the letterpress printing press is designed to operate as a numbering press, the first and second letterpress cylinders being numbering cylinders carrying a plurality of numbering devices.

* * * * *